US008408828B2

(12) United States Patent
Ouchi

(10) Patent No.: US 8,408,828 B2
(45) Date of Patent: Apr. 2, 2013

(54) IMAGE RECORDING APPARATUS

(75) Inventor: Tetsuya Ouchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 337 days.

(21) Appl. No.: 12/860,483

(22) Filed: Aug. 20, 2010

(65) Prior Publication Data

US 2011/0076082 A1 Mar. 31, 2011

(30) Foreign Application Priority Data

Sep. 30, 2009 (JP) ..... 2009-227859

(51) Int. Cl.
*B41J 11/44* (2006.01)
*B41J 13/00* (2006.01)

(52) U.S. Cl. ..... 400/76; 400/578; 347/164; 347/101; 347/104

(58) Field of Classification Search ..... 347/104, 347/16; 400/578; 399/388, 396
See application file for complete search history.

(56) References Cited

U.S. PATENT DOCUMENTS 6,731,890 B1 * 5/2004 Rakov et al. ..... 399/66
7,360,854 B2 * 4/2008 Morisaki ..... 347/14
7,883,202 B2 * 2/2011 Yoshida ..... 347/104
7,912,384 B2 * 3/2011 Dan ..... 399/16
2007/0242089 A1 10/2007 Mukai

FOREIGN PATENT DOCUMENTS

| | | | |
|---|---|---|---|
| JP | 2000-062975 | A | 2/2000 |
| JP | 2000-120661 | A | 4/2000 |
| JP | 2002-283637 | A | 10/2002 |
| JP | 2004-025605 | A | 1/2004 |
| JP | 2000-095379 | A | 4/2004 |
| JP | 2006-023605 | A | 1/2006 |
| JP | 2007-203546 | A | 8/2007 |

* cited by examiner

*Primary Examiner* — Matthew G Marini
(74) *Attorney, Agent, or Firm* — Baker Botts L.L.P.

(57) ABSTRACT

An image recording apparatus wherein the controller is configured to adjust a distance between a first recording medium and a second recording medium fed subsequently to the first recording medium in a medium feeding direction on the basis of a length L1 of a trailing-end marginal area of the first recording medium, a length L2 of a leading-end marginal area of the second recording medium, and a length L0 of a feeding-path recording area on a medium feeding path in the medium feeding direction such that the first recording medium and the second recording medium are not overlapped with each other in the feeding-path recording area and such that respective image recorded areas of the first recording medium and the second recording medium are not disposed on the feeding-path recording area at the same time.

13 Claims, 9 Drawing Sheets

CASE: (L1+L2)<L0
SHEET FEEDING DISTANCE
Lp IS LONGER THAN L0

CASE: (L1+L2)≧L0
SHEET FEEDING DISTANCE
Lp IS SHORTER THAN L0

IMAGE RECORDING APPARATUS

CROSS REFERENCE TO RELATED APPLICATION

The present application claims priority from Japanese Patent Application No. 2009-227859, which was filed on Sep. 30, 2009, the disclosure of which is herein incorporated by reference in its entirety.

BACKGROUND OF THE INVENTION

1. Field of the Invention

The present invention relates to an image recording apparatus configured to record an image on a recording medium.

2. Description of the Related Art

There is conventionally known an image recording apparatus such as an ink-jet printer as an image recording apparatus configured to record an image on a recording sheet. In the image recording apparatus of this type, a recording unit is moved or reciprocated in a main scanning direction to record an image on an area of a recording sheet located under the recording unit while the recording sheet is fed in a sub-scanning direction by a predetermined distance in each reciprocation, whereby an entire image is recorded on the recording sheet.

Further, as the conventional image recording apparatus, there is known an image recording apparatus in which a subsequent sheet is overlapped with a marginal area of a preceding sheet in image recording on a plurality of recording sheets.

SUMMARY OF THE INVENTION

Meanwhile, in the conventional apparatus in which the subsequent sheet is overlapped with the marginal area of the preceding sheet from an upper side of the preceding sheet, a distance between the recording unit and a surface of the recording sheet is changed by a thickness of the recording sheet in an area in which the subsequent sheet and the preceding sheet are overlapped with each other. Thus, a quality of the image recorded on the recording sheet deteriorates due to the change of the distance between the recording unit and the surface of the recording sheet.

For example, in the image recording apparatus such as an ink-jet printer configured to record the image on the recording sheet by ejecting ink droplets from the recording head while moving the recording head in the main scanning direction, the ink droplets are attached to or landed on the recording sheet by flying downward while moving in the main scanning direction due to inertia. Thus, where the distance between the recording head and the surface of the recording sheet has been changed, a distance of the movement of the ink droplets in the main scanning direction from the ejection of the ink droplets to the attachment of the ink droplets to the recording sheet has been changed, whereby a position of the attachment (i.e., a landing position) of each ink droplet deviates from an intended position. In particular, where the recording head is reciprocated and the ink droplets are ejected from the recording head in a forward path and a backward path of the reciprocation of the recording head, uneven image recording is unfortunately performed between passes of the image to be recorded on the recording sheet by the deviation of the landing positions between an ejecting operation of the ink droplets in the forward path and an ejecting operation of the ink droplets in the backward path.

It is an object of the present invention to provide an image recording apparatus configured to perform a medium feeding control of a subsequent medium which is preferable to that of a conventional apparatus.

The object indicated above may be achieved according to the present invention which provides an image recording apparatus comprising: an image recording unit configured to record an image on a recording medium located at a feeding-path recording area as a specific area on a medium feeding path through which the recording medium is fed; a medium-feed mechanism configured to feed the recording medium through the medium feeding path from an upstream side thereof to a downstream side thereof in a medium feeding direction such that the recording medium passes through the feeding-path recording area; a medium-supply mechanism configured to supply the recording medium to the medium-feed mechanism from a position located on an upstream side of the medium-feed mechanism in the medium feeding direction; and a controller configured to control the supply and the feed of the recording medium by controlling the medium-supply mechanism and the medium-feed mechanism, wherein the controller includes: a first specifying section configured to specify a length L1 of a trailing-end marginal area of a first recording medium in the medium feeding direction, the first recording medium being a recording medium on which an image is recorded at the feeding-path recording area and the trailing-end marginal area being a marginal area on which the image is not recorded and which is an upstream-side portion of the first recording medium in the medium feeding direction; and a second specifying section configured to specify a length L2 of a leading-end marginal area of a second recording medium in the medium feeding direction, the second recording medium being a recording medium fed to the feeding-path recording area subsequently to the first recording medium and the leading-end marginal area being a marginal area on which the image is not recorded and which is a downstream-side portion of the second recording medium in the medium feeding direction, and wherein the controller is configured to adjust a length between the first recording medium and the second recording medium in the medium feeding direction on the basis of the length L1 specified by the first specifying section, the length L2 specified by the second specifying section, and a length L0 of the feeding-path recording area in the medium feeding direction such that the first recording medium and the second recording medium are not overlapped with each other in the feeding-path recording area and such that an image recorded area of the first recording medium on which the image is to be recorded and an image recorded area of the second recording medium on which the image is to be recorded are not disposed on the feeding-path recording area at the same time.

The object indicated above may be achieved according to the present invention which provides an image recording apparatus comprising: an image recording unit configured to record an image on a recording medium located at a feeding-path recording area as a specific area on a medium feeding path through which the recording medium is fed; a medium-feed mechanism configured to feed the recording medium through the medium feeding path from an upstream side thereof to a downstream side thereof in a medium feeding direction such that the recording medium passes through the feeding-path recording area; a medium-supply mechanism configured to supply the recording medium to the medium-feed mechanism from a position located on an upstream side of the medium-feed mechanism in the medium feeding direction; and a controller configured to control the supply and the feed of the recording medium by controlling the medium-supply mechanism and the medium-feed mechanism, wherein the controller includes: a first specifying section configured to specify a length L1 of a trailing-end marginal area of a first recording medium in the medium feeding direction, the first recording medium being a recording medium on which an image is recorded at the feeding-path recording area and the trailing-end marginal area being a marginal area on which the image is not recorded and which is an upstream-side portion of the first recording medium in the medium feeding direction; and a second specifying section configured to specify a length L2 of a leading-end marginal area of a second recording medium in the medium feeding direction, the second recording medium being a recording medium fed to the feeding-path recording area subsequently to the first recording medium and the leading-end marginal area being a marginal area on which the image is not recorded and which is a downstream-side portion of the second recording medium in the medium feeding direction, wherein the controller is configured to adjust a length between the first recording medium and the second recording medium in the medium feeding direction on the basis of the length L1 specified by the first specifying section, the length L2 specified by the second specifying section, and a length L0 of the feeding-path recording area in the medium feeding direction such that the first recording medium and the second recording medium are not overlapped with each other in the feeding-path recording area and such that an image recorded area of the first recording medium on which the image is to be recorded and an image recorded area of the second recording medium on which the image is to be recorded are not disposed on the feeding-path recording area at the same time, and wherein the controller further includes: a judging section configured to judge whether a total length (L1+L2) which is a sum of the length L1 specified by the first specifying section and the length L2 specified by the second specifying section is equal to or longer than the length L0 of the feeding-path recording area in the medium feeding direction or not; and an adjusting section configured to adjust the length between the first recording medium and the second recording medium in the medium feeding direction such that the length between the first recording medium and the second recording medium in the feeding-path recording area becomes equal to or shorter than the length L0 where the judging section has judged that the total length (L1+L2) is equal to or longer than the length L0.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DESCRIPTION OF THE EMBODIMENTS

Figure 1:
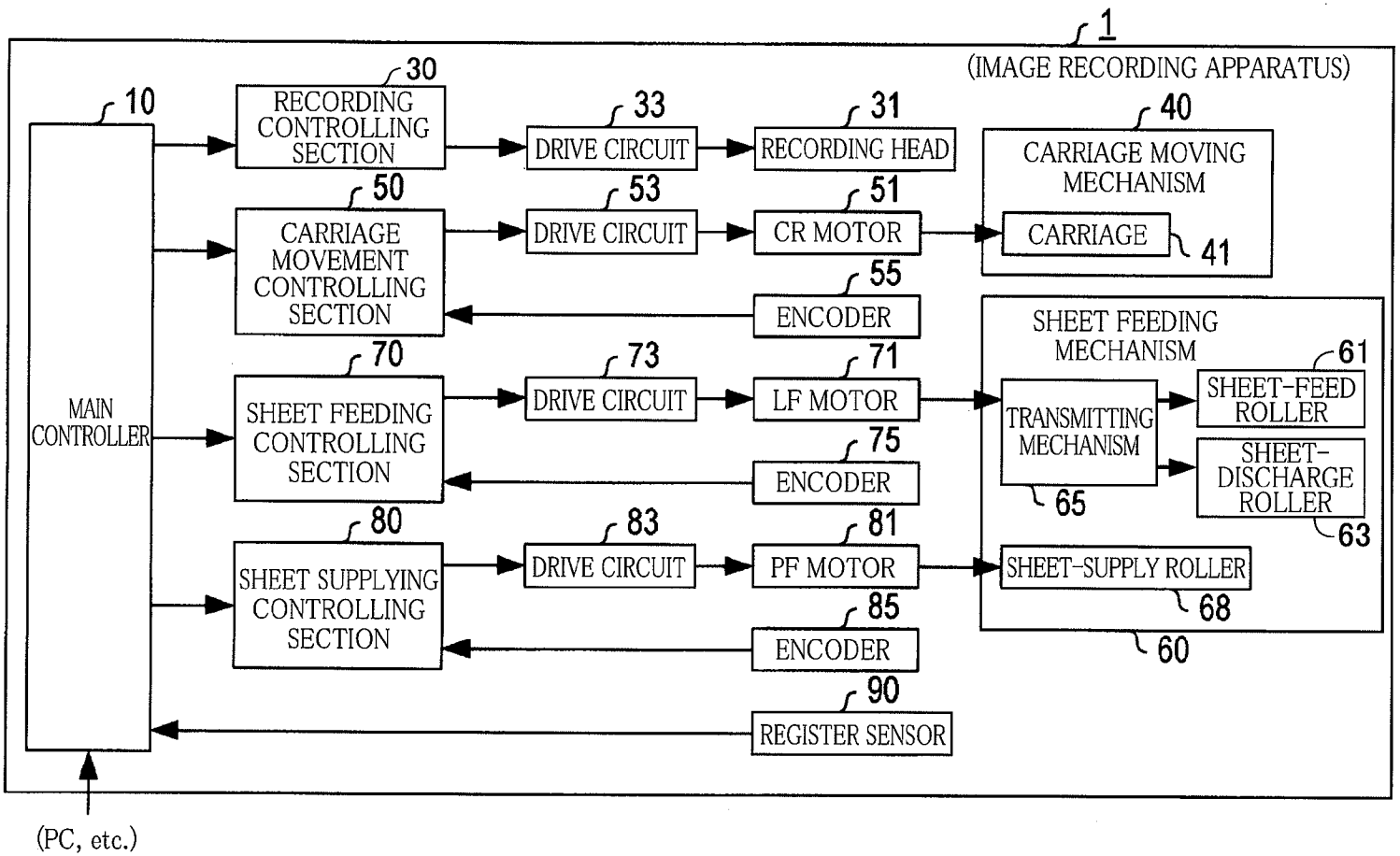
FIG. 1 is a block diagram showing an electric construction of an image recording apparatus 1.

Hereinafter, there will be described first and second embodiments of the present invention by reference to the drawings. An image recording apparatus 1 of ink-jet type as the present first embodiment shown in the drawings such as FIG. 1 is configured to record or form an image on a recording sheet as a recording medium on the basis of print data provided or transmitted from an external device such as a PC. This image recording apparatus 1 includes a main controller 10 configured to control overall operations of the image recording apparatus 1, a recording controlling section 30, a carriage movement controlling section 50, a sheet feeding controlling section 70, and a sheet supplying controlling section 80. It is noted that functions performed by the respective controller and controlling sections 10, 30, 50, 70, 80 can be realized by processings by a software using hardware circuits or a microcomputer, or realized by combinations of these processings.

Figure 2A:
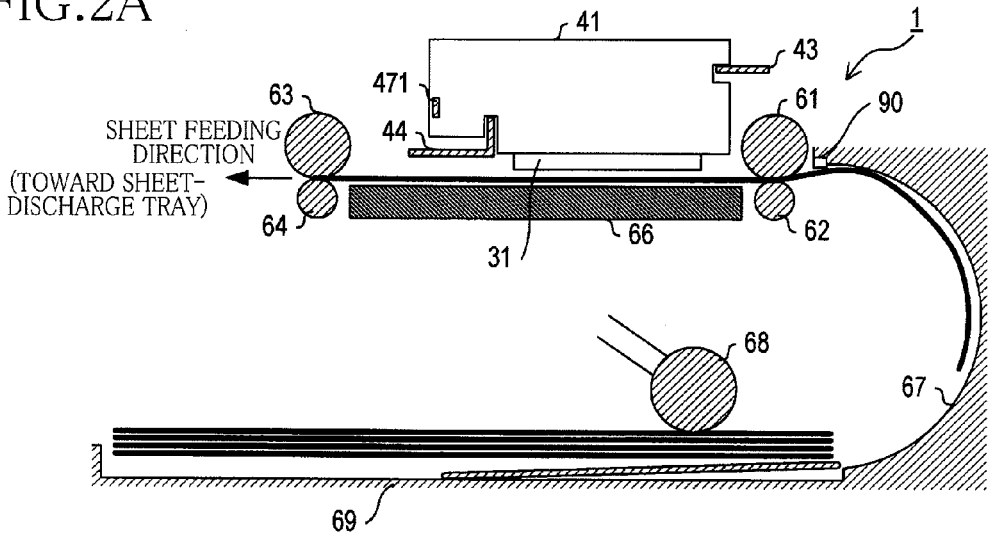
FIGS. 2A and 2B are views showing constructions of a carriage moving mechanism 40 and a sheet feeding mechanism 60.
Figure 2B:
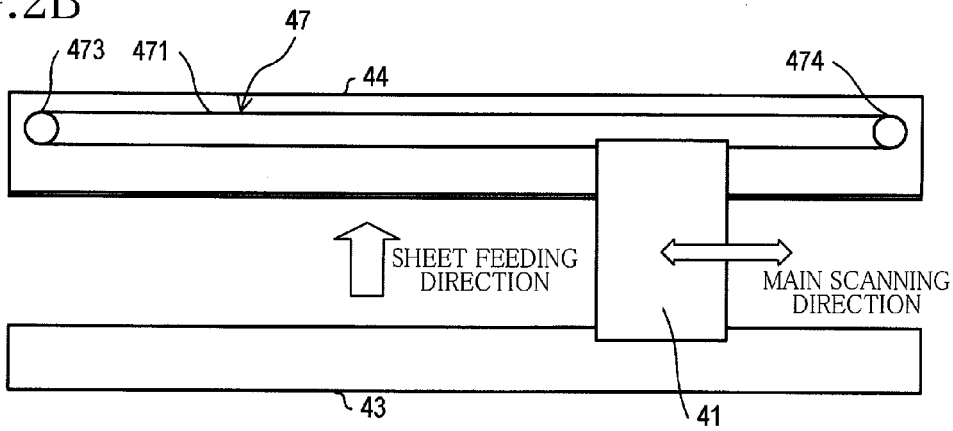

This image recording apparatus 1 includes, in addition to the controller and controlling sections 10, 30, 50, 70, 80, a recording head 31 as an image recording portion configured to eject ink droplets downward, a drive circuit 33 configured to drive the recording head 31, a carriage moving mechanism 40 (specifically shown in FIGS. 2A and 2B) having a carriage 41 as a moving portion on which the recording head 31 is mounted, a CR motor 51 configured to apply a drive force to the carriage 41, a drive circuit 53 configured to drive the CR motor 51, a linear encoder 55 for measuring a position and a moving speed of the carriage 41, a sheet feeding mechanism 60, an LF motor 71 configured to apply a drive force to a sheet-feed roller 61 as a part of an upstream-side sheet-feed unit and a sheet-discharge roller 63 included in the sheet feeding mechanism 60, a drive circuit 73 configured to drive the LF motor 71, a rotary encoder 75 for measuring a rotational amount of the LF motor 71, a PF motor 81 configured to apply a drive force to a sheet-supply roller 68 as a part of a medium-supply mechanism included in the sheet feeding mechanism 60, a drive circuit 83 configured to drive the PF motor 81, a rotary encoder 85 for measuring a rotational amount of the PF motor 81, and a register sensor 90 for detecting ends of the sheet. It is noted that FIG. 2A is a cross-sectional view showing general constructions of the carriage moving mechanism 40 and the sheet feeding mechanism 60 of the image recording apparatus 1, and FIG. 2B is a top view showing a general construction of the carriage moving mechanism 40.

Specifically explained, the recording controlling section 30 controls the ejection of the ink droplets from the recording head 31 by inputting a control signal to the drive circuit 33 and records or forms the image on the sheet on the basis of the print data transmitted from the external device such as the PC. In the present embodiment, the main controller 10 is provided with an interface, not shown, such as a USB interface for carrying out a data communication with the external device such as the PC. The print data constituted by a plurality of image data respectively corresponding to pages of an object to be recorded is inputted to the image recording apparatus 1 from the external device such as the PC through the interface.

Further, the carriage movement controlling section 50 controls the CR motor 51 by inputting the control signal to the drive circuit 53. The carriage movement controlling section 50 controls the movement of the carriage 41 by controlling the CP motor 51, thereby reciprocating the carriage 41 at a constant speed in a main scanning direction (with reference to FIG. 2B). This carriage movement controlling section 50 measures the position and the moving speed of the carriage 41 on the basis of an encoder signal inputted from the linear encoder 55 and moves the carriage 41 at the constant speed in the main scanning direction to a turning point of the reciprocation by controlling the CR motor 51 on the basis of a result of this measurement.

It is noted that the carriage movement controlling section 50 stops the carriage 41 at the turning point by decelerating the carriage 41 immediately in front of the turning point. Further, while the carriage movement controlling section 50 controls the movement of the carriage 41, the recording controlling section 30 controls the recording head 31 such that the recording head 31 ejects the ink droplets in a pattern corresponding to the print data. In this operation, a part of the image which corresponds to a predetermined line is recorded in the main scanning direction on the sheet under the carriage 41 each time when the carriage 41 is moved to the turning point in the main scanning direction. In view of the above, the recording head 31 and the carriage 41 constitute an image recording unit.

In the following explanation, the control of the carriage movement controlling section 50 for the movement of the carriage 41 to the turning point in the main scanning direction may be referred to as a "control of the movement of the carriage 41 corresponding to one pass". Further, a sheet feeding path (i.e., a medium feeding path) through which the sheet is fed in a sheet feeding direction (i.e., a medium feeding direction) includes an area at which the image can be recorded on the sheet by "the control of the movement of the carriage 41 corresponding to one pass" with the ejection of the ink droplets from the recording head 31. This area may be referred to as an "image recording area" or a "sheet-feeding-path recording area (feeding-path recording area)".

There will be next explained the sheet feeding controlling section 70. The sheet feeding controlling section 70 is configured to control the LF motor 71 by inputting the control signal to the drive circuit 73. The drive force generated by the LF motor 71 is transmitted through a drive-force transmitting mechanism 65 to (a) the sheet-feed roller 61 (with reference to FIG. 2A) located on the sheet feeding path at a position on an upstream side of the image recording area in the sheet feeding direction and (b) the sheet-discharge roller 63 located on the sheet feeding path at a position on a downstream side of the image recording area in the sheet feeding direction.

The image recording apparatus 1 includes a driven roller 62 as a part of an upstream-side sheet-feed unit which is disposed so as to face the sheet-feed roller 61 and rotated by the rotation of the sheet-feed roller 61. The rotations of the sheet-feed roller 61 and the driven roller 62 cause the sheet to be fed or pulled into a position between the sheet-feed roller 61 and the driven roller 62 on the sheet feeding path from an upstream side in the sheet feeding direction and fed to the image recording area.

Further, the image recording apparatus 1 includes a driven roller 64 (with reference to FIG. 2A) which is disposed so as to face the sheet-discharge roller 63 and rotated by the rotation of the sheet-discharge roller 63. The rotations of the sheet-discharge roller 63 and the driven roller 64 cause the sheet to be fed to a position on the sheet feeding path which is located on a downstream side of the image recording area in the sheet feeding direction and then discharged.

That is, the sheet feeding controlling section 70 controls, by controlling the rotations of the sheet-feed roller 61 and the sheet-discharge roller 63 via the LF motor 71, the sheet feeding mechanism 60 such that the sheet is fed along the sheet feeding path in a sub-scanning direction coinciding with the sheet feeding direction from an upstream position toward a downstream position respectively on an upstream side and a downstream side of the image recording area in the sheet feeding direction. Specifically, the sheet feeding controlling section 70 measures a sheet feeding amount on the basis of an encoder signal inputted from the rotary encoder 75 and controls the LF motor 71 on the basis of a result of this measurement such that the sheet is fed by an amount corresponding to a command from the main controller 10. As a result, the sheet feeding mechanism 60 feeds the sheet in the sub-scanning direction perpendicular to the main scanning direction in which the carriage 41 is moved.

The sheet supplying controlling section 80 is configured to control the PF motor 81 by inputting the control signal to the drive circuit 83. It is noted that the drive force generated by the PF motor 81 is transmitted to the sheet-supply roller 68 which is brought into contact with the sheet placed on a sheet-supply tray 69.

That is, the sheet supplying controlling section 80 controls the PF motor 81 such that the sheet-supply roller 68 is rotated, whereby an uppermost one of the sheets placed on the sheet-supply tray 69 is fed toward the downstream side in the sheet feeding direction through the sheet feeding path and supplied to the position between the sheet-feed roller 61 and the driven roller 62 located on a downstream side of the sheet-supply tray 69 in the sheet feeding direction.

Specifically, the sheet supplying controlling section 80 measures the sheet feeding amount on the basis of an encoder signal inputted from the rotary encoder 85 and controls the PF motor 81 on the basis of a result of this measurement such that the sheet is fed by an amount corresponding to a command from the main controller 10.

Further, the sheet feeding mechanism 60 includes the sheet-feed roller 61, the sheet-discharge roller 63, the driven rollers 62, 64, and the sheet-supply roller 68 and further includes the sheet-supply tray 69 on which the sheets to be supplied are placed in a state in which the sheets are stacked on each other, and a U-turn path 67 and a platen 66 each of which partly constitutes the sheet feeding path.

That is, the sheet feeding mechanism 60 is configured to separate, by the rotation of the sheet-supply roller 68, the sheets placed on the sheet-supply tray 69 one by one from the sheet-supply tray 69, then supply each sheet to the U-turn path 67, and then feed the sheet through the U-turn path 67 to the position between the sheet-feed roller 61 and the driven roller 62 located on a downstream side of the sheet-supply tray 69 in the sheet feeding direction.

Further, this sheet feeding mechanism 60 is configured to feed, by the rotation of the sheet-feed roller 61, the sheet having been fed to the position between the sheet-feed roller 61 and the driven roller 62, through the sheet feeding path toward the downstream side in the sheet feeding direction. The sheet fed by the sheet-feed roller 61 is fed toward the downstream side through a position between the platen 66 and the recording head 31 while being supported at a lower face of the sheet by the platen 66.

The sheet feeding mechanism 60 nips the sheet fed in a manner as described above, by the sheet-discharge roller 63 and the driven roller 64 disposed on the sheet feeding path on a downstream side of the platen 66 in the sheet feeding direction and discharges the sheet onto a sheet-discharge tray, not shown, by the rotation of the sheet-discharge roller 63.

It is noted that, as described above, the register sensor 90 is provided at a position on the sheet feeding path which is located slightly on an upstream side of the sheet-feed roller 61 in the sheet feeding direction and is configured to sense a leading end and a trailing end of the sheet passing through the position and input a result of this sense to the main controller 10 and the controlling sections 70, 80 which control the sheet feeding. The image recording apparatus 1 as the present embodiment accurately specifies a position of the sheet on the sheet feeding path on the basis of the result of the sense of the register sensor 90 and information about the sheet feeding amount obtained by the encoder signals.

Further, as shown in FIG. 2B, the carriage moving mechanism 40 as a moving portion includes the carriage 41 on which the recording head 31 is mounted, frames 43, 44 which guide the carriage 41 in the main scanning direction, and a belt mechanism 47. The carriage moving mechanism 40 is configured such that the carriage 41 is slidably mounted on the frames 43, 44 extending in the main scanning direction and connected to an endless belt 471 partly constituting the belt mechanism 47.

The belt mechanism 47 includes the endless belt 471 and a pair of pulleys 473, 474 respectively disposed at opposite ends of the frame 44 in the main scanning direction. The endless belt 471 is wound around the pulleys 473, 474 so as to be tensioned between the pulleys 473, 474.

The above-described CR motor 51 is connected to one of the pulleys 473, 474 via gears, not shown, so as to rotate the one of the pulleys 473, 474. The one of the pulleys 473, 474 is rotated by receiving the drive force generated by the CR motor 51 via the gears. The other of the pulleys 473, 474 is driven or rotated via the endless belt 471 by the rotation of the one of the pulleys 473, 474 which is rotated by receiving the drive force of the CR motor 51.

The carriage moving mechanism 40 moves the carriage 41 whose movable direction is restricted to the main scanning direction by the frames 43, 44, in the main scanning direction via the endless belt 471 rotated by receiving the drive force of the CR motor 51 as thus described.

Figure 3:
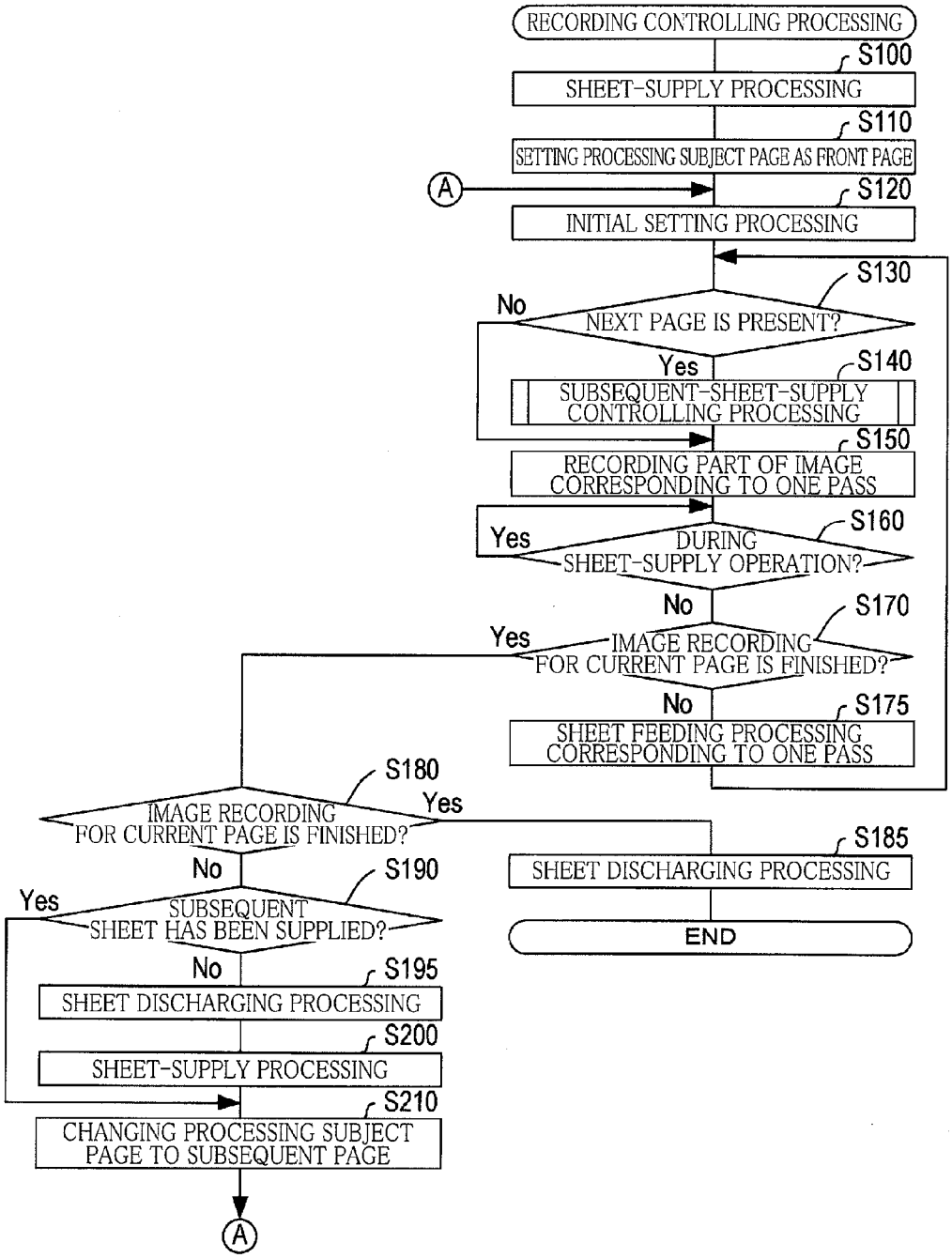
FIG. 3 is a flow-chart showing a recording controlling processing performed by a main controller 10.

There will be next explained a recording controlling processing performed by the main controller 10 with reference to FIG. 3. When the print data has been inputted from the external device such as the PC, the main controller 10 performs the recording controlling processing shown in FIG. 3. In this processing, the inputted print data is processed, whereby images of respective pages based on the print data are respectively recorded on the sheets different from each other.

Specifically, the main controller 10 efficiently feeds a subsequent sheet (i.e., a trailing sheet), by performing the recording controlling processing shown in FIG. 3, such that a preceding sheet (i.e., a leading sheet) and the subsequent sheet do not overlap with each other in the image recording area and such that a non-marginal area of the preceding sheet and a non-marginal area of the subsequent sheet are not disposed in the image recording area at the same time. It is noted that a "marginal area" is an area in the sheet which is located on an inside of four edges of the rectangular sheet and in which the image is not recorded in an area (i.e., a four-edges area) near and along the four edges, while the "non-marginal area" is an area in the sheet other than the marginal area. In the present embodiment, the print data inputted from the external device to the image recording apparatus 1 stores margin setting information about image data which respectively correspond to the pages and which constitute the print data. As a result, the marginal area is set in the image data corresponding to each page.

As described above, the main controller 10 performs the sheet feeding such that the preceding sheet and the subsequent sheet do not overlap with each other in the image recording area. This is for preventing a deterioration of a quality of the image recorded on the sheet, the deterioration being caused by a change of an attachment manner or a landing manner of the ink droplets on the sheet due to a change of a distance from a sheet surface on which the image is to be recorded and a nozzle face 31*a* (with reference to FIGS. 5A and 5B) of the recording head 31 by the overlap between the preceding sheet and the subsequent sheet.

Further, as described above, the main controller 10 performs the sheet feeding such that the non-marginal area of the preceding sheet and the non-marginal area of the subsequent sheet are not disposed in the image recording area at the same time. This is for avoiding a complicated control for the image recording. In the present embodiment, a series of the image recording on the sheet is performed by repeating the image recording control corresponding to one pass which is performed in accordance with the control of the movement of the carriage 41 which corresponds to one pass. However, where the non-marginal area of the preceding sheet and the non-marginal area of the subsequent sheet are disposed in the image recording area at the same time, the image recording on the preceding sheet and the image recording on the subsequent sheet need to be performed at the same time upon the image recording control corresponding to one pass, while considering a positional relationship between the preceding sheet and the subsequent sheet. Such an image recording control is very complicated. In the present embodiment, in order to avoid this complicated image recording control, the main controller 10 performs the sheet feeding such that the non-marginal area of the preceding sheet and the non-marginal area of the subsequent sheet are not disposed in the image recording area at the same time.

In the recording controlling processing, when the print data is inputted, the main controller 10 initially performs in S100 a sheet-supply processing. That is, the main controller 10 controls the sheet supplying controlling section 80 such that the uppermost one of the sheets placed on the sheet-supply tray 69 is supplied to the position between the sheet-feed roller 61 and the driven roller 62. Further, in this time, oblique feeding of the sheet is corrected, in other words, an oblique feeding correction is performed.

Specifically, in S100, the main controller 10 inputs a command to the sheet supplying controlling section 80 such that the sheet is fed by a sheet feeding amount ($La+\alpha$) obtained by adding a redundant amount a required for the oblique feeding correction to a sheet feeding amount La required for the uppermost sheet to be moved to the position between the sheet-feed roller 61 and the driven roller 62. The sheet supplying controlling section 80 having received this command controls the PF motor 81 such that the sheet feeding mechanism 60 feeds the uppermost sheet by the sheet feeding amount ($La+\alpha$) toward the downstream side in the sheet feeding direction along the sheet feeding path.

It is noted that the sheet-feed roller 61 is being stopped during the sheet feeding in S100. Thus, where the sheet is fed by an amount (i.e., a distance) which is larger by the redundant amount a than the sheet feeding amount La required for the uppermost sheet to be moved to the position between the sheet-feed roller 61 and the driven roller 62, the sheet is brought into strong contact with the position between the sheet-feed roller 61 and the driven roller 62, thereby being subjected to the oblique feeding correction.

Where a sheet-supply operation including the oblique feeding correction is finished by the sheet feeding mechanism 60 on the basis of this sheet-supply processing, this recording controlling processing goes to S110 in which the main controller 10 sets a processing subject page as a front page. Then, in S120, the main controller 10 performs an initial setting processing in which the sheet is fed to a recording-start-position at which a first line of the image is to be recorded.

Specifically, in S120, the main controller 10 specifies a length of a marginal area of a leading end portion (hereinafter may be referred to as a "leading-end-portion marginal area" or a "leading-end marginal area") of the sheet on which an image of the processing subject page is to be recorded, on the basis of margin setting information about image data of the processing subject page which partly constitutes the print data. Then, the main controller 10 specifies, on the basis of this length of the leading-end-portion marginal area, a sheet feeding amount required for a front or leading end of the non-marginal area of the sheet to reach a front or leading end of the image recording area in the sheet feeding path. It is noted that the "leading-end-portion marginal area" is a part of the marginal area located along and near the four edges of the sheet, the part being located on the most downstream side in the sheet feeding direction in the marginal area. In other words, the "leading-end-portion marginal area" is a part of the marginal area which corresponds to a leading end portion of the sheet in the sheet feeding direction when the sheet is fed.

After this specification, the main controller 10 inputs a command to the sheet feeding controlling section 70 such that the sheet is fed by the sheet feeding amount. As a result of this input of the command, the sheet-feed roller 61 of the sheet feeding mechanism 60 is rotated, whereby the supplied sheet is fed toward the downstream side in the sheet feeding direction through the sheet feeding path, and the initial setting operation is performed.

Further, the initial setting operation of the sheet feeding mechanism 60 based on the initial setting processing is finished, the main controller 10 judges in S130 whether there is image data corresponding to a page following the processing subject page (i.e., a subsequent page or a next page) or not on the basis of the print data. Then, where the main controller 10 has judged that there is the image data corresponding to the subsequent page (S130: Yes), the main controller 10 performs in S140 a subsequent-sheet-supply controlling processing shown in FIG. 4, and this recording controlling processing goes to S150. On the other hand, where the main controller 10 has judged that there is no image data corresponding to the subsequent page (S130: No), this recording controlling processing skips S140 and goes to S150.

Explained in detail later, in this subsequent-sheet-supply controlling processing, where predetermined conditions are satisfied, the main controller 10 controls the sheet feeding mechanism 60 by performing the sheet-supply processing such that the sheet-supply operation is started for the subsequent sheet. As a result, the subsequent sheet on which the image of the subsequent page is to be recorded is supplied to the sheet-feed roller 61.

Further, in S150, the main controller 10 controls the carriage movement controlling section 50 such that the carriage movement controlling section 50 performs the control of the movement of the carriage 41 corresponding to one pass, and controls the recording controlling section 30 such that the recording controlling section 30 performs the image recording control corresponding to one pass. In this processing, a part of the image corresponding to one pass is recorded on an area of the sheet which is disposed in the image recording area. It is noted that a width of the part of the image in the sub-scanning direction corresponds to a length L0 of the image recording area in the sub-scanning direction.

Further, where the control of the movement of the carriage 41 corresponding to one pass is finished, this recording controlling processing goes to S160 in which the main controller 10 waits until the sheet-supply operation of the sheet feeding mechanism 60 is finished. Then, where the sheet-supply operation is finished, this recording controlling processing goes to S170. It is noted that the processing of S160 is a processing for not rotating the sheet-feed roller 61 until the sheet-supply operation (including the oblique feeding correction) which is started in S140 by the sheet feeding mechanism 60 is finished. Thus, where the sheet-supply operation has not been started in S140, the main controller 10 has judged that the sheet is not being supplied (S160: No), this recording controlling processing goes to S170 without waiting.

Further, in S170, the main controller 10 judges whether the image recording for the processing subject page is completely finished to the last line or not. Where the main controller 10 has judged that the image recording for the processing subject page is not completely finished (S170: No), the main controller 10 performs a sheet feeding processing in S175. Specifically, the main controller 10 inputs a command to the sheet feeding controlling section 70 such that the sheet is fed or conveyed by an amount corresponding to the width (i.e., the length L0) of the part of the image corresponding to one pass. Then, the sheet feeding controlling section 70 drives the LF motor 71 such that the sheet feeding mechanism 60 feeds the sheet toward the downstream side in the sheet feeding direction through the sheet feeding path by the rotations of the sheet-feed roller 61 and the sheet-discharge roller 63 by the amount corresponding to the width (i.e., the length L0) of the part of the image corresponding to one pass.

Further, where this processing is finished, this recording controlling processing returns to S130 and S150 in which the main controller 10 controls a processing in which another part of the image corresponding to one pass is recorded on the fed sheet. By repeating these processings, the main controller 10 performs a control in which an entire image is recorded on the sheet. Then, where the image recording of the sheet on the basis of the image data corresponding to the processing subject page is completely finished (S170: Yes), this recording controlling processing goes to S180.

Further, in S180, the main controller 10 judges whether the image recording based on the image data corresponding to the last page has been finished or not. That is, the main controller 10 judges whether the image recording for the entire image is finished or not. Where the main controller 10 has judged that the image recording based on the image data corresponding to the last page has been finished (S180: Yes), the main controller 10 performs a sheet discharging processing in S185. That is, the main controller 10 controls the sheet feeding controlling section 70 such that the sheet feeding controlling section 70 drives the LF motor 71 to rotate the sheet-discharge roller 63, whereby the sheet is fed through the sheet-discharge roller 63 and discharged to the sheet-discharge tray, not shown. Then, the recording controlling processing is finished.

On the other hand, the main controller 10 has judged that the image recording based on the image data corresponding to the last page has not been finished (S180: No), the main controller 10 judges in S190 whether the subsequent sheet has been supplied to the sheet-feed roller 61 or not. Where the main controller 10 has judged that the subsequent sheet has not been supplied to the sheet-feed roller 61 (S190: No), the main controller 10 performs in S195 the sheet discharging processing in the similar manner to the processing of S185, whereby the sheet is discharged to the sheet-discharge tray.

Where the sheet discharging operation in S195 by the sheet feeding mechanism 60 has been finished, the main controller 10 performs in S200 the sheet-supply processing in the similar manner to the processing of S100, whereby a sheet on which the image of the subsequent page is to be recorded is supplied to the sheet-feed roller 61 while being subjected to the oblique feeding correction. It is noted that the performance of the sheet-supply processing in S200 is limited basically to the case where the marginal area is too large, and thus the image recording for the previous page is finished before conditions for performing the sheet-supply processing in S140 have been satisfied.

Then, where the sheet-supply operation by the sheet feeding mechanism 60 has been finished, the main controller 10 changes in S210 the processing subject page to the subsequent page, and this recording controlling processing goes to S120. Then, the main controller 10 performs the following processings for the processing subject page after the change.

However, in pages from a second page, the length of the leading-end-portion marginal area of the sheet on which the image of the processing subject page is to be recorded has been specified in the processing of S140 which has been performed when the processing subject page is the previous page (this operation will be described in greater detail below). Thus, in S120, the initial setting processing is performed on the basis of this information. Further, in the case where the sheet-supply processing is performed in S140, the sheet has been already fed to a position on a downstream side of the sheet-feed roller 61 in S120 in the operation for each of the pages from the second page. In this case, the initial setting operation of the sheet is performed by specifying the sheet feeding amount on the basis of a current position of the sheet.

Figure 4:
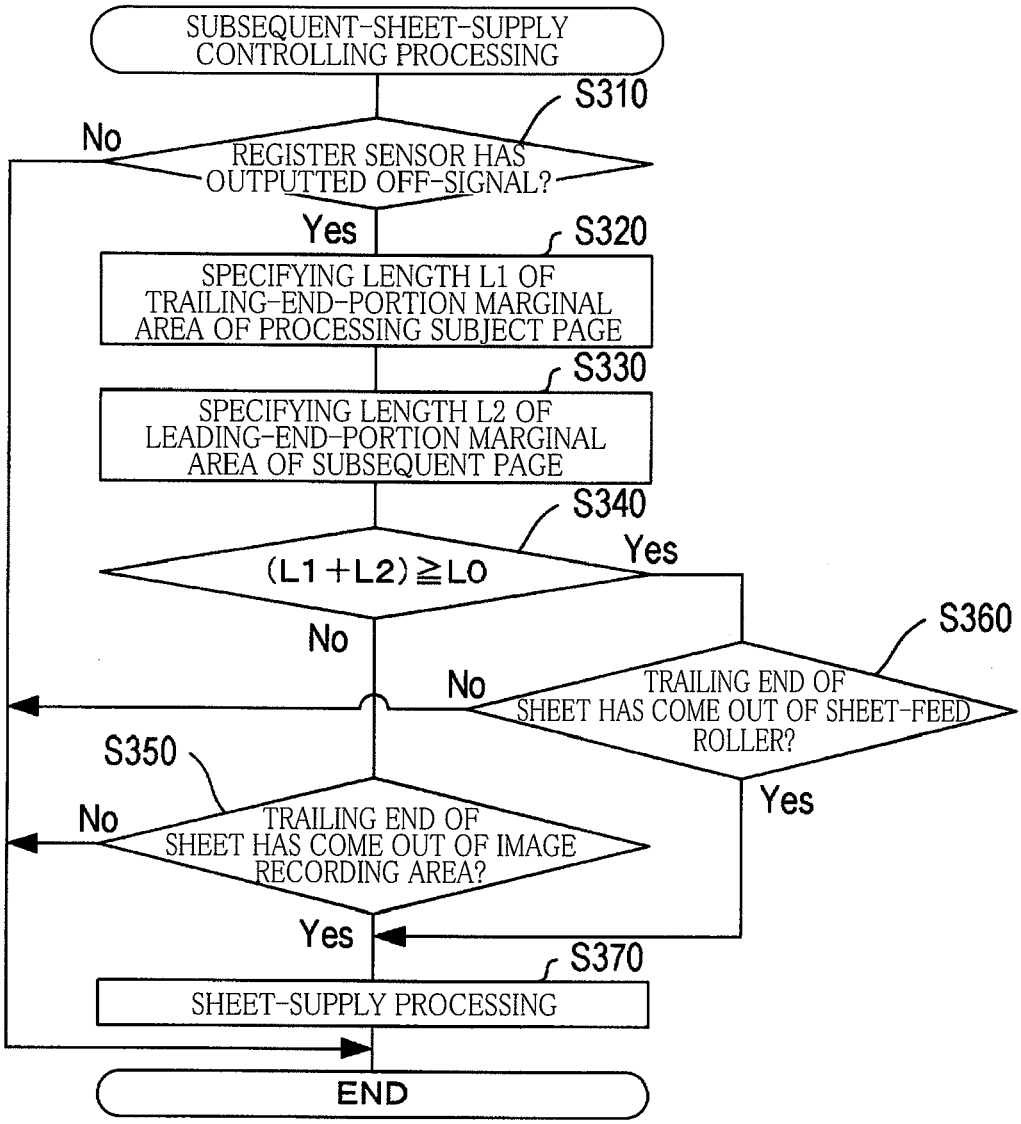
FIG. 4 is a flow-chart showing a subsequent-sheet-supply controlling processing performed by the main controller 10 in a first embodiment.

There will be next explained the subsequent-sheet-supply controlling processing performed in S140 by the main controller 10 with reference to FIG. 4. In this subsequent-sheet-supply controlling processing shown in FIG. 4, the main controller 10 initially judges in S310 whether an output signal of the register sensor 90 is an off-signal or not. It is noted that the register sensor 90 outputs an on-signal where the sheet exists on an area of the sheet feeding path which faces the register sensor 90, and the register sensor 90 outputs the off-signal where the sheet does not exist on the area.

Where the main controller 10 has judged that the output signal of the register sensor 90 is not the off-signal (S310: No), the main controller 10 does not perform processings from S320, and the subsequent-sheet-supply controlling processing is finished. That is, where the sheet exists at a position facing the register sensor 90, the subsequent-sheet-supply controlling processing is finished without performing the sheet-supply processing.

On the other hand, where the main controller 10 has judged that the output signal of the register sensor 90 is the off-signal (S310: Yes), the main controller 10 specifies in S320 a length L1 of a trailing-end-portion marginal area (a trailing-end marginal area) of the sheet on which the image of the processing subject page is to be recorded, on the basis of margin setting information about image data of the processing subject page which partly constitutes the print data. It is noted that the "trailing-end-portion marginal area" is a part of the marginal area located along and near the four edges of the sheet, the part being located on the most upstream side in the sheet feeding direction in the marginal area. In other words, the "trailing-end-portion marginal area" is a part of the marginal area which corresponds to a trailing end portion of the sheet in the sheet feeding direction when the sheet is fed.

After the processing of S320, the main controller 10 specifies in S330 a length L2 of the leading-end-portion marginal area of the sheet on which the image of the subsequent page is to be recorded, on the basis of margin setting information about the image data corresponding to the subsequent page which is subsequent to the processing subject page. Then, in S340, the main controller 10 judges whether a total length or value (L1+L2) obtained by adding the length L1 specified in S320 to the length L2 specified in S330 is equal to or longer than the length L0 of the image recording area in the sub-scanning direction or not.

It is noted that the main controller 10 obtains information about the length L0 of the image recording area in the sub-scanning direction from a storage device, not shown, such as an EEPROM in the image recording apparatus 1. However, the length L0 of the image recording, area in the sub-scanning direction varies in accordance with an operational mode or setting of the recording head 31 such as a recording resolution. Thus, in S340, the main controller 10 obtains the information about the length L0 corresponding to the operational mode of the recording head 31 which is currently set.

Where the main controller 10 has judged that the length (L1+L2) is shorter than the length L0 (S340: No), the main controller 10 judges in S350 whether the trailing end of the sheet for the processing subject page has come out of or passed through the image recording area or not. It is noted that the main controller 10 judges in S350 whether the trailing end of the sheet has come out of the image recording area or not on the basis of a sheet feeding amount by the sheet-feed roller 61 from the sense of the trailing end (or the leading end) of the sheet for the processing subject page by the register sensor 90, that is, on the basis of the rotational amount of the LF motor 71 which is detected by the rotary encoder 75. Where the main controller 10 has judged in S350 that the trailing end of the sheet has not come out of the image recording area (S350: No), the subsequent-sheet-supply controlling processing is finished.

On the other hand, where the main controller 10 has judged that the trailing end of the sheet has come out of the image recording area (S350: Yes), the main controller 10 performs in S370 the sheet-supply processing in a similar manner to the processing in S100, such that the sheet feeding mechanism 60 starts the sheet-supply operation for the subsequent sheet. Then, the subsequent-sheet-supply controlling processing is finished. However, in this processing, the subsequent-sheet-supply controlling processing is finished at a time when the sheet-supply processing is performed, and goes to S150 in the recording controlling processing, without waiting a completion of the sheet-supply operation by the sheet feeding mechanism 60. As a result, the image recording on the preceding sheet is performed concurrently with the sheet-supply operation.

Where the main controller 10 has judged that the length (L1+L2) is equal to or longer than the length L0 (S340: Yes), the main controller 10 judges in S360 whether the trailing end of the sheet for the processing subject page has come out of or passed through the sheet-feed roller 61 toward the downstream side in the sheet feeding direction or not. It is noted that the main controller 10 judges in S360 whether the trailing end of the sheet for the processing subject page has come out of the sheet-feed roller 61 toward the downstream side or not on the basis of a sheet feeding amount by the register sensor 90 from the sense of the trailing end (or the leading end) of the sheet for the processing subject page.

Where the main controller 10 has judged that the trailing end of the sheet has come out of the sheet-feed roller 61 toward the downstream side (S360: Yes), the main controller 10 performs the sheet-supply processing in S370. On the other hand, where the main controller 10 has judged that the trailing end of the sheet has not come out of the sheet-feed roller 61 toward the downstream side (S360: No), the subsequent-sheet-supply controlling processing is finished without performing the sheet-supply processing.

Figure 5A:
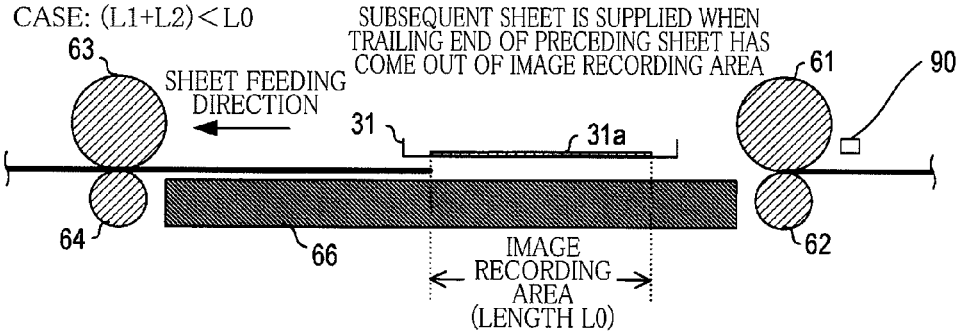
FIGS. 5A and 5B are views for explaining a sheet feeding in the first embodiment.
Figure 5B:
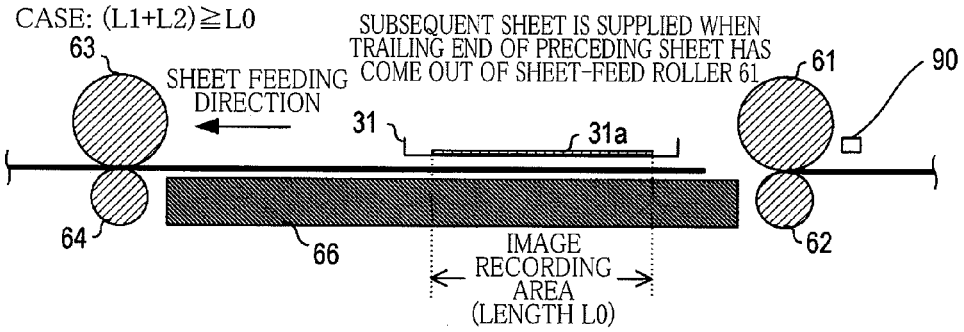

While the content of the subsequent-sheet-supply controlling processing has been explained, FIG. 5A is a cross-sectional view of the sheet feeding path showing a positional relationship between the preceding sheet and the subsequent sheet where the total length (L1+L2) of the marginal areas is shorter than the length L0. FIG. 5B is a cross-sectional view of the sheet feeding path showing a positional relationship between the preceding sheet and the subsequent sheet where the total length (L1+L2) of the marginal areas is equal to or longer than the length L0.

Figure 6A:
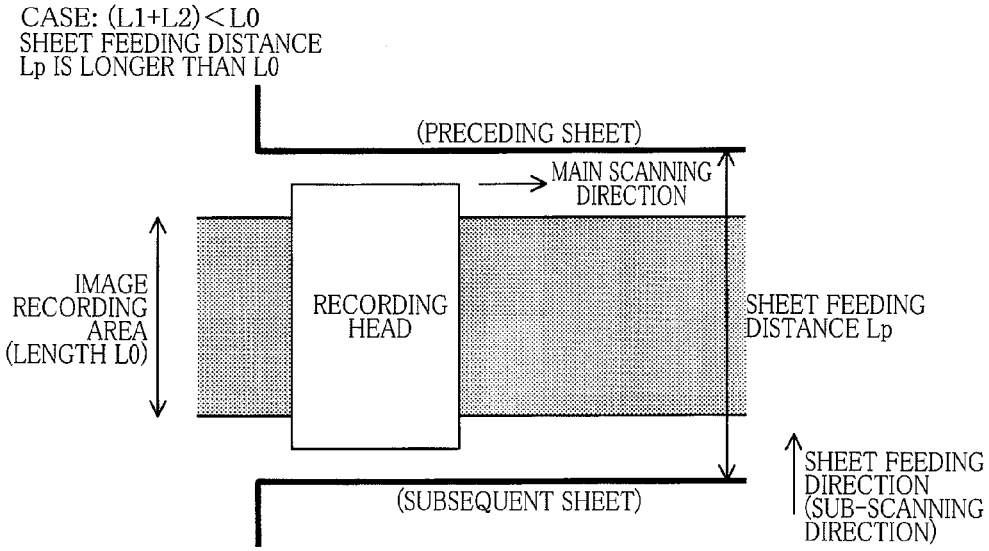
FIGS. 6A and 6B are views for explaining the sheet feeding in the first embodiment.
Figure 6B:
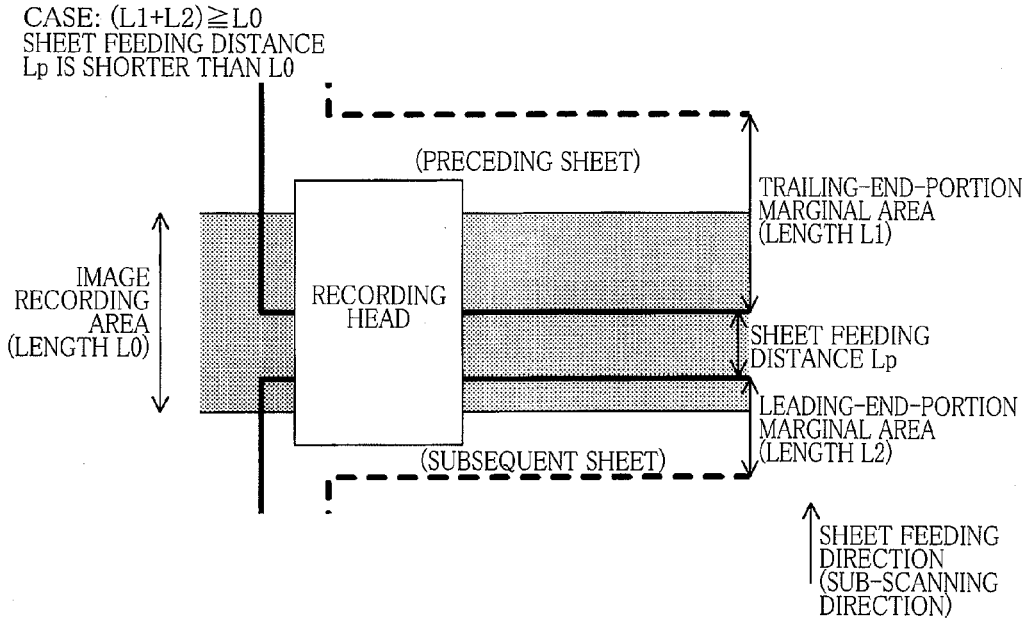

Further, FIG. 6A shows a sheet feeding distance (length) Lp between the preceding sheet and the subsequent sheet where the total length (L1+L2) of the marginal areas is shorter than the length L0. FIG. 6B shows a sheet feeding distance Lp between the preceding sheet and the subsequent sheet where the total length (L1+L2) of the marginal areas is equal to or longer than the length L0.

As shown in FIGS. 5A, 5B, 6A, and 6B, in the case where the total length (L1+L2) of the marginal areas is shorter than the length L0, when the above-described subsequent-sheet-supply controlling processing in S140 is performed, the subsequent sheet is supplied after the trailing end of the preceding sheet has come out of the leading end of the image recording area. Thus, the sheet feeding distance Lp between the preceding sheet and the subsequent sheet is longer than the length L0. Further, in the case where the total length (L1+L2) of the marginal areas is equal to or longer than the length L0, when the above-described subsequent-sheet-supply controlling processing in S140 is performed, the subsequent sheet is supplied where the trailing end of the preceding sheet has come out of the sheet-feed roller 61 at the time when the preceding sheet fed by the distance corresponding to one pass has been stopped. Thus, the sheet feeding distance Lp between the preceding sheet and the subsequent sheet is basically shorter than the length L0.

Thus, as this subsequent-sheet-supply controlling processing, where the total length (L1+L2) of the marginal areas is shorter than the length L0, the sheet-supply operation is started at a second timing or a third timing at which the trailing end of the sheet has come out of the image recording area, while where the total length (L1+L2) of the marginal areas is equal to or longer than the length L0, the sheet-supply operation is started at a first timing or a fourth timing at which the trailing end of the sheet has come out of the sheet-feed roller 61. Where the sheet-supply operation is thus started, the sheet feeding can be performed such that the preceding sheet and the subsequent sheet do not overlap with each other in the image recording area and such that the non-marginal area of the preceding sheet and the non-marginal area of the subsequent sheet are not disposed in the image recording area at a time. Further, the subsequent sheet can be fed by an appropriate sheet feeding distance Lp in accordance with a size of the marginal areas.

Further, this sheet feeding control can be performed by a simple control in which a timing of the start of the sheet-supply operation is changed, thereby improving a throughput for successive recording by the simple control and avoiding the deterioration of the image quality due to the overlapped sheets. Further, in this image recording apparatus 1, it is possible to eliminate a need to provide a mechanism or the like for, e.g., lifting a trailing end of a preceding sheet and moving a leading end of a subsequent sheet to a position under the trailing end of the preceding sheet as a conventional technique in order to overlap the trailing end of the preceding sheet and the leading end of the subsequent sheet with each other.

Further, in this image recording apparatus 1, the sheet-supply operation is performed during the stop of the sheet-feed roller 61, and the oblique feeding correction of the sheet is performed, thereby suppressing the deterioration of the image quality caused by the oblique feeding of the sheet to the image recording area.

There will be next explained a second embodiment of the present invention with reference to FIGS. 7, 8A, 8B, 9A, and 9B. This second embodiment is different from the first embodiment in the judgment of S350 in the subsequent-sheet-supply controlling processing in the first embodiment. The same reference numerals as used in the first embodiment are used to designate the corresponding elements of the second embodiment, and an explanation of which is dispensed with.

Figure 7:
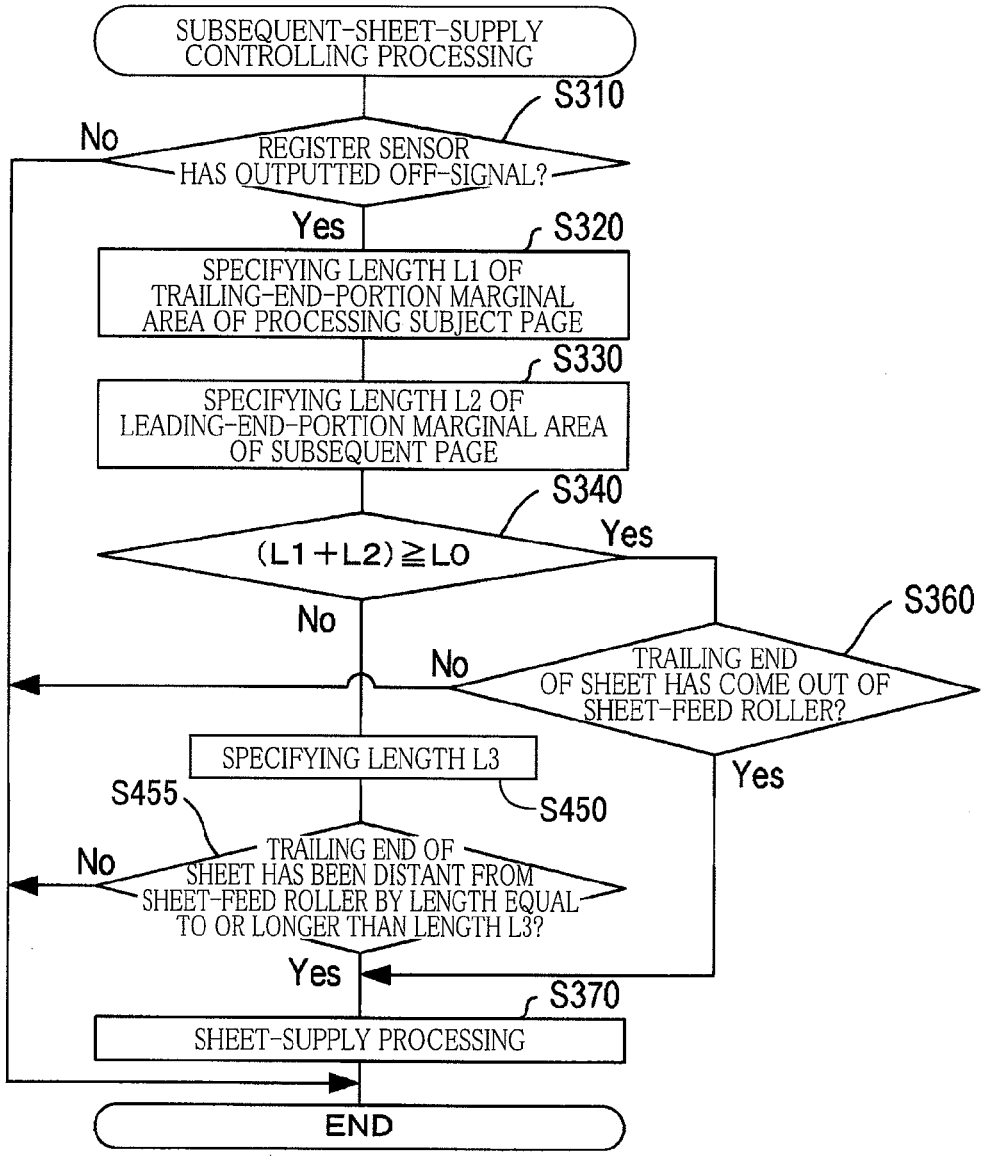
FIG. 7 is a flow-chart showing a subsequent-sheet-supply controlling processing performed by the main controller 10 in a second embodiment.
Figure 8A:
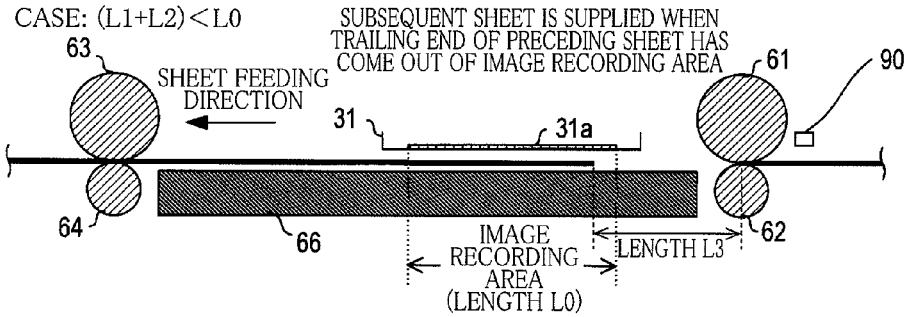
FIGS. 8A and 8B are views for explaining a sheet feeding in the second embodiment.
Figure 8B:
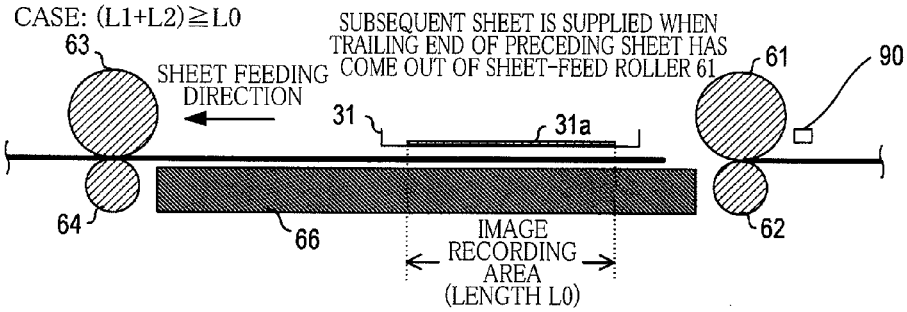
Figure 9A:
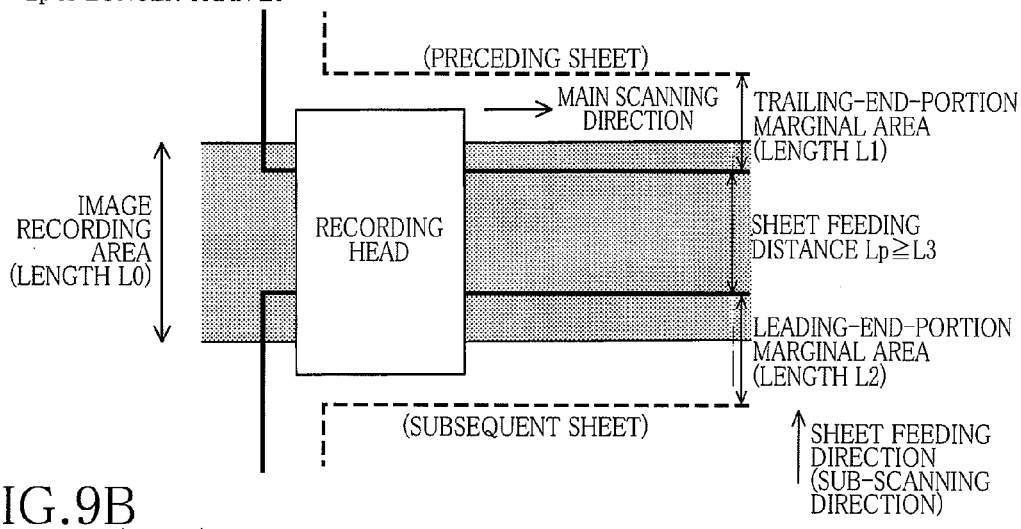
FIGS. 9A and 9B are views for explaining the sheet feeding in the second embodiment.
Figure 9B:
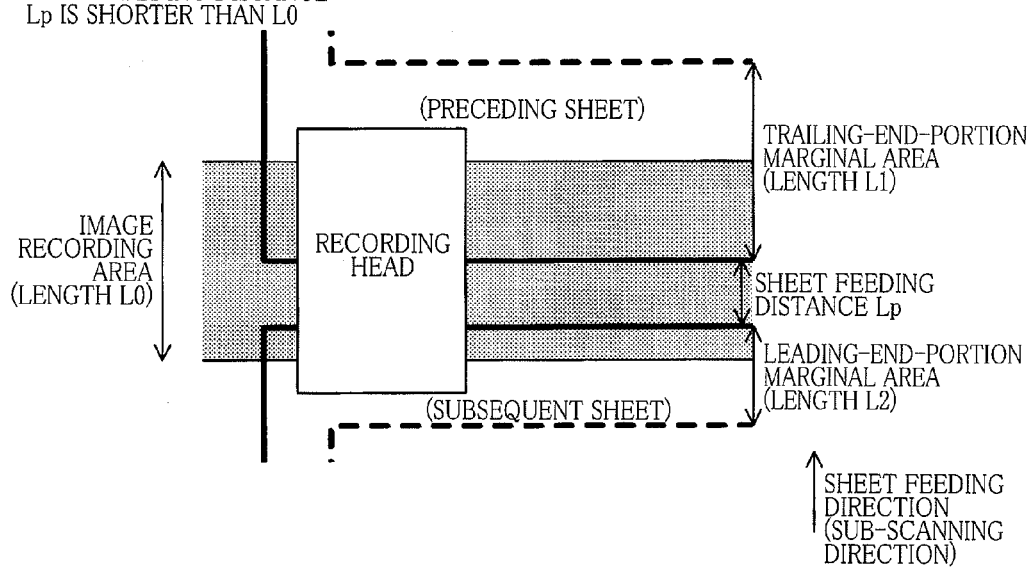

As shown in FIG. 7, in the second embodiment, in S340 in the subsequent-sheet-supply controlling processing, the main controller 10 judges whether the total length (L1+L2) as a sum of the length L1 specified in S320 and the length L2 specified in S330 is equal to or longer than the length L0 of the image recording area in the sub-scanning direction or not. Where the main controller 10 has judged that the total length (L1+L2) is shorter than the length L0 (S340: No), this subsequent-sheet-supply controlling processing goes to S450. In S450, the main controller 10 sets a length L3 from the sheet-feed roller 61 to a specific position on the sheet feeding path which is located on a downstream side of the sheet-feed roller 61 in the sheet feeding direction. Here, the length L3 is set as a length or a value such that a total length or value as a sum of the length L1, the length L2, and the length L3 is longer than the length L0. That is, the length L3 is set as the length satisfying an expression "L1+L2+L3>L0". Then, in S455, the main controller 10 judges whether the trailing end of the sheet for the processing subject page has been fed and distant from the sheet-feed roller 61 toward the downstream side in the sheet feeding direction by a length equal to or longer than the length L3 or not (with reference to FIG. 8A). Where the main controller 10 has judged that the trailing end of the sheet for the processing subject page has been fed and distant from the sheet-feed roller 61 toward the downstream side in the sheet feeding direction by the length equal to or longer than the length L3 (S455: Yes), this subsequent-sheet-supply controlling processing goes to S370 in which the sheet-supply processing is performed. In this case, as shown in FIG. 9A, since the sheet feeding distance Lp between the trailing end of the preceding sheet and the leading end of the subsequent sheet is equal to or longer than the length L3, and the expression "L1+L2+L3>L0" is satisfied, the non-marginal areas of the preceding sheet and the non-marginal area of the subsequent sheet are disposed in the image recording area at the same time. It is noted that the judgment as to whether or not the trailing end of the sheet for the processing subject page is distant from the sheet-feed roller 61 toward the downstream side by the length equal to or longer than the length L3 is performed on the basis of the sheet feeding amount of the sheet-feed roller 61 and the sheet feeding amount of the sheet-discharge roller 63 from the sense of the trailing end of the sheet for the processing subject page by the register sensor 90, that is, on the basis of the rotational amount of the LF motor 71 which is detected by the rotary encoder 75. On the other hand, where the main controller 10 has judged that the trailing end of the sheet for the processing subject page is not distant from the sheet-feed roller 61 toward the downstream side by the length equal to or longer than the length L3 (S455: No), the subsequent-sheet-supply controlling processing is finished without performing the sheet-supply processing.

Thus, in the second embodiment, even where the total length (L1+L2) is shorter than the length L0, the sheet feeding distance Lp between the preceding sheet and the subsequent sheet is set to a value smaller than that in the first embodiment, thereby improving the throughput for the successive recording.

In view of the above, the main controller 10 can be considered to include a first specifying section configured to specify the length L1 of the trailing-end-portion marginal area of the preceding sheet in the sheet feeding direction. This first specifying section can be considered to perform the processing of S320. Further, the main controller 10 can be considered to include a second specifying section configured to specify the length L2 of the leading-end-portion marginal area of the subsequent sheet in the sheet feeding direction. This second specifying section can be considered to perform the processing of S330. Further, the main controller 10 can be considered to include a judging section configured to judge whether the total length (L1+L2) is equal to or longer than the length L0 in the sheet feeding direction or not. This judging section can be considered to perform the processing of S340. Further, the main controller 10 can be considered to include an adjusting section considered to perform the processings of S350, S360, S370, and S455.

While the embodiments of the present invention has been described above, it is to be understood that the invention is not limited to the details of the illustrated embodiments, but may be embodied with various changes and modifications, which may occur to those skilled in the art, without departing from the spirit and scope of the invention. For example, the sheet feeding control for the preceding sheet and the subsequent sheet is not limited to the above-described configuration, and various configurations can be employed as the sheet feeding control. However, where the sheet feeding control is performed as described above, the object of the present invention can be achieved by a simple control.

It is noted that the sheet feeding control for the preceding sheet and the subsequent sheet may be performed in the following manner. That is, a feeding speed of the preceding sheet and a feeding speed of the subsequent sheet may be controlled such that the preceding sheet and the subsequent sheet do not overlap with each other in the image recording area and such that the non-marginal area of the preceding sheet and the non-marginal area of the subsequent sheet are not disposed in the image recording area at the same time, for example.

That is, the main controller 10 may set a timing of the supply of the subsequent sheet on the basis of a rotational speed of the sheet-feed roller 61 upon feeding the preceding sheet, a rotational speed of the sheet-supply roller 68 upon supplying the subsequent sheet, and a distance from the leading end of the subsequent sheet placed on the sheet-supply tray 69 to the trailing end of the preceding sheet such that the sheet feeding distance Lp between the preceding sheet and the subsequent sheet in the image recording area is shorter than the length L0 where the total length (L1+L2) of the marginal areas is equal to or longer than the length L0.

Further, the sheet feeding control for the preceding sheet and the subsequent sheet may be performed such that the sheet-feed roller 61 and the sheet-discharge roller 63 are driven independently of each other, and the sheet-supply roller 68 is driven to supply the sheet always at the same timing. That is, the sheet feeding control may be performed in the following manner. When the trailing end of the preceding sheet has come out of the sheet-feed roller 61, the subsequent sheet is supplied to the sheet-feed roller 61. Then, the main controller 10 recognizes the sheet feeding amount of the preceding sheet on the basis of the rotational amount of the sheet-discharge roller 63. Where the total length (L1+L2) of the marginal areas is equal to or longer than the length L0, the subsequent sheet is fed by the rotation of the sheet-feed roller 61 at a timing when the distance between the trailing end of the preceding sheet and the leading end of the subsequent sheet becomes smaller than the length L0 in the image recording area. Where the total length (L1+L2) of the marginal areas is shorter than the length L0, the subsequent sheet is fed by the rotation of the sheet-feed roller 61 at a timing when the distance between the trailing end of the preceding sheet and the leading end of the subsequent sheet becomes larger than the length L0 in the image recording area.

It is noted that, in the above-described embodiments, the main controller 10 judges whether the total length (L1+L2) is equal to or longer than the length L0 or not and performs the sheet-supply processing in accordance with the result of this judgment. However, any configuration can be employed as the configuration of this image recording apparatus 1 as long as the sheet-supply processing is performed such that condition A in which the preceding sheet and the subsequent sheet do not overlap with each other in the image recording area and condition B in which the non-marginal area of the preceding sheet and the non-marginal area of the subsequent sheet are not disposed in the image recording area at the same time are satisfied. For example, this image recording apparatus 1 may be configured such that the main controller 10 does not perform the judgment as to whether the total length (L1+L2) is equal to or longer than the length L0 or not, and performs the sheet-supply processing by setting the sheet feeding distance Lp between the preceding sheet and the subsequent sheet so as to satisfy the conditions A and B. In this case, the conditions A and B are satisfied by setting the sheet feeding distance Lp such that the sum of the length L1, the length L2, and the sheet feeding distance Lp is longer than the length L0.

What is claimed is:

1. An image recording apparatus comprising:

an image recording unit configured to record an image on a recording medium located at a feeding-path recording area as a specific area on a medium feeding path through which the recording medium is fed;

a medium-feed mechanism configured to feed the recording medium through the medium feeding path from an upstream side thereof to a downstream side thereof in a medium feeding direction such that the recording medium passes through the feeding-path recording area;

a medium-supply mechanism configured to supply the recording medium to the medium-feed mechanism from a position located on an upstream side of the medium-feed mechanism in the medium feeding direction; and a controller configured to control the supply and the feed of the recording medium by controlling the medium-supply mechanism and the medium-feed mechanism, wherein the controller includes:

a first specifying section configured to specify a length L1 of a trailing-end marginal area of a first recording medium in the medium feeding direction, the first recording medium being a recording medium on which an image is recorded at the feeding-path recording area and the trailing-end marginal area being a marginal area on which the image is not recorded and which is an upstream-side portion of the first recording medium in the medium feeding direction; and a second specifying section configured to specify a length L2 of a leading-end marginal area of a second recording medium in the medium feeding direction, the second recording medium being a recording medium fed to the feeding-path recording area subsequently to the first recording medium and the leading-end marginal area being a marginal area on which the image is not recorded and which is a downstream-side portion of the second recording medium in the medium feeding direction, and wherein the controller is configured to adjust a length between the first recording medium and the second recording medium in the medium feeding direction on the basis of the length L1 specified by the first specifying section, the length L2 specified by the second specifying section, and a length L0 of the feeding-path recording area in the medium feeding direction such that the first recording medium and the second recording medium are not overlapped with each other in the feeding-path recording area and such that an image recorded area of the first recording medium on which the image is to be recorded and an image recorded area of the second recording medium on which the image is to be recorded are not disposed on the feeding-path recording area at the same time.

2. The image recording apparatus according to claim 1, wherein the controller further includes:

a judging section configured to judge whether a total length (L1+L2) which is a sum of the length L1 specified by the first specifying section and the length L2 specified by the second specifying section is equal to or longer than the length L0 of the feeding-path recording area in the medium feeding direction or not; and an adjusting section configured to adjust the length between the first recording medium and the second recording medium in the medium feeding direction such that the first recording medium and the second recording medium are not overlapped with each other in the feeding-path recording area where the judging section has judged that the total length (L1+L2) is equal to or longer than the length L0.

3. The image recording apparatus according to claim 2, wherein the adjusting section is configured to adjust, where the judging section has judged that the total length (L1+L2) is not equal to or longer than the length L0, the length between the first recording medium and the second recording medium in the medium feeding direction such that the length between the first recording medium and the second recording medium in the feeding-path recording area becomes longer than the length between the first recording medium and the second recording medium which length is adjusted by the adjusting section where the judging section has judged that the total length (L1+L2) is equal to or longer than the length L0.

4. The image recording apparatus according to claim 1, wherein the controller further includes:

a judging section configured to judge whether a total length (L1+L2) which is a sum of the length L1 specified by the first specifying section and the length L2 specified by the second specifying section is equal to or longer than the length L0 of the feeding-path recording area in the medium feeding direction or not; and an adjusting section configured to adjust the length between the first recording medium and the second recording medium in the medium feeding direction such that a sum of the total length (L1+L2) and the length between the first recording medium and the second recording medium in the feeding-path recording area becomes longer than the length L0 where the judging section has judged that the total length (L1+L2) is not equal to or longer than the length L0.

5. The image recording apparatus according to claim 1, wherein the controller further includes:

a judging section configured to judge whether a total length (L 1+L2) which is a sum of the length L1 specified by the first specifying section and the length L2 specified by the second specifying section is equal to or longer than the length L0 of the feeding-path recording area in the medium feeding direction or not; and an adjusting section configured to adjust the length between the first recording medium and the second recording medium in the medium feeding direction such that the length between the first recording medium and the second recording medium in the feeding-path recording area becomes equal to or longer than the length L0 where the judging section has judged that the total length (L1+L2) is not equal to or longer than the length L0.

6. The image recording apparatus according to claim 2, wherein the controller is configured to control, where the judging section has judged that the total length (L1+L2) is equal to or longer than the length L0, the medium-supply mechanism to start to supply the second recording medium toward the medium-feed mechanism at a first timing such that the first recording medium and the second recording medium are not overlapped with each other in the feeding-path recording area, and configured to control, where the judging section has judged that the total length (L1+L2) is not equal to or longer than the length L0, the medium-supply mechanism to start to supply the second recording medium toward the medium-feed mechanism at a second timing such that the length between the first recording medium and the second recording medium in the feeding-path recording area becomes longer than the length between the first recording medium and the second recording medium which length is adjusted by the adjusting section where the judging section has judged that the total length (L1+L2) is equal to or longer than the length L0, and wherein the first timing is a timing which is earlier than the second timing.

7. The image recording apparatus according to claim 1, wherein the controller further includes:

a judging section configured to judge whether a total length (L1+L2) which is a sum of the length L1 specified by the first specifying section and the length L2 specified by the second specifying section is equal to or longer than the length L0 of the feeding-path recording area in the medium feeding direction or not; and an adjusting section configured to adjust the length between the first recording medium and the second recording medium in the medium feeding direction such that the length between the first recording medium and the second recording medium in the feeding-path recording area becomes longer than the length L0 where the judging section has judged that the total length (L1+L2) is not equal to or longer than the length L0, and configured to adjust the length between the first recording medium and the second recording medium in the medium feeding direction such that the length between the first recording medium and the second recording medium in the feeding-path recording area becomes equal to or shorter than the length L0 where the judging section has judged that the total length (L1+L2) is equal to or longer than the length L0.

8. The image recording apparatus according to claim 7, wherein the controller configured to control, where the judging section has judged that the total length (L1+L2) is not equal to or longer than the length L0, the medium-supply mechanism to start to supply the second recording medium toward the medium-feed mechanism at a third timing such that the length between the first recording medium and the second recording medium in the feeding-path recording area becomes longer than the length L0, and configured to control, where the judging section has judged that the total length (L1+L2) is equal to or longer than the length L0, the medium-supply mechanism to start to supply the second recording medium toward the medium-feed mechanism at a fourth timing such that the length between the first recording medium and the second recording medium in the feeding-path recording area becomes equal to or shorter than the length L0, and wherein the fourth timing is a timing which is earlier than the third timing.

9. The image recording apparatus according to claim 8, wherein the third timing is a timing at which a trailing end of the first recording medium passes through a downstream-side end portion of the feeding-path recording area, and wherein the fourth timing is a timing at which the trailing end of the first recording medium passes through a position on the medium feeding path at which the feed of the recording medium by the medium-feed mechanism is started and which is located on an upstream side of the feeding-path recording area in the medium feeding direction.

10. The image recording apparatus according to claim 2, wherein the medium-feed mechanism includes an upstream-side medium-feed unit disposed at a position on the medium feeding path which is located on an upstream side of the feeding-path recording area in the medium feeding direction, and configured to feed the recording medium supplied by the medium-supply mechanism, to the feeding-path recording area, wherein the controller is configured to control the feed of the recording medium by operating the upstream-side medium-feed unit intermittently such that the recording medium supplied from the medium-supply mechanism to the medium-feed mechanism is fed to the feeding-path recording area by a predetermined amount at a time, and wherein the controller is configured to control, where the judging section has judged that the total length (L1+L2) is equal to or longer than the length L0, to operate the medium-supply mechanism to feed the second recording medium during an initial stop of the upstream-side medium-feed unit after a trailing end of the first recording medium has passed through the upstream-side medium-feed unit, such that a leading end of the second recording medium reaches the upstream-side medium-feed unit being stopped, the controller being configured to operate the stopped upstream-side medium-feed unit after the leading end of the second recording medium has reached the upstream-side medium-feed unit.

11. The image recording apparatus according to claim 10, wherein the upstream-side medium-feed unit is constituted by a medium-feed roller as a drive roller configured to rotate and a driven roller configured to be rotated by the rotation of the medium-feed roller, the medium-feed roller and the driven roller being configured to rotate while nipping the recording medium supplied by the medium-supply mechanism, and wherein the controller is configured to control to operate the medium-supply mechanism such that the recording medium is fed during a stop of the medium-feed roller by an amount larger than a feeding amount by which the recording medium is fed to a position at which the medium-feed roller and the driven roller nip the recording medium.

12. The image recording apparatus according to claim 1, wherein the image recording unit includes an image recording portion configured to record the image on the recording medium and a moving portion configured to reciprocate the image recording portion in a direction perpendicular to the medium feeding direction, and wherein the feeding-path recording area is an area on the medium feeding path at which the image is recordable in a forward path or a backward path of the reciprocation of the image recording portion by the moving portion.

13. An image recording apparatus comprising:

an image recording unit configured to record an image on a recording medium located at a feeding-path recording area as a specific area on a medium feeding path through which the recording medium is fed;

a medium-feed mechanism configured to feed the recording medium through the medium feeding path from an upstream side thereof to a downstream side thereof in a medium feeding direction such that the recording medium passes through the feeding-path recording area;

a medium-supply mechanism configured to supply the recording medium to the medium-feed mechanism from a position located on an upstream side of the medium-feed mechanism in the medium feeding direction; and a controller configured to control the supply and the feed of the recording medium by controlling the medium-supply mechanism and the medium-feed mechanism, wherein the controller includes:

a first specifying section configured to specify a length L1 of a trailing-end marginal area of a first recording medium in the medium feeding direction, the first recording medium being a recording medium on which an image is recorded at the feeding-path recording area and the trailing-end marginal area being a marginal area on which the image is not recorded and which is an upstream-side portion of the first recording medium in the medium feeding direction; and a second specifying section configured to specify a length L2 of a leading-end marginal area of a second recording medium in the medium feeding direction, the second recording medium being a recording medium fed to the feeding-path recording area subsequently to the first recording medium and the leading-end marginal area being a marginal area on which the image is not recorded and which is a downstream-side portion of the second recording medium in the medium feeding direction, wherein the controller is configured to adjust a length between the first recording medium and the second recording medium in the medium feeding direction on the basis of the length L1 specified by the first specifying section, the length L2 specified by the second specifying section, and a length L0 of the feeding-path recording area in the medium feeding direction such that the first recording medium and the second recording medium are not overlapped with each other in the feeding-path recording area and such that an image recorded area of the first recording medium on which the image is to be recorded and an image recorded area of the second recording medium on which the image is to be recorded are not disposed on the feeding-path recording area at the same time, and wherein the controller further includes:

a judging section configured to judge whether a total length (L1+L2) which is a sum of the length L1 specified by the first specifying section and the length L2 specified by the second specifying section is equal to or longer than the length L0 of the feeding-path recording area in the medium feeding direction or not; and an adjusting section configured to adjust the length between the first recording medium and the second recording medium in the medium feeding direction such that the length between the first recording medium and the second recording medium in the feeding-path recording area becomes equal to or shorter than the length L0 where the judging section has judged that the total length (L1+L2) is equal to or longer than the length L0.

* * * * *